US010875314B2

(12) United States Patent
Duca et al.

(10) Patent No.: US 10,875,314 B2
(45) Date of Patent: Dec. 29, 2020

(54) SECURE REFILL SYSTEM

(71) Applicant: SICPA HOLDING SA, Prilly (CH)

(72) Inventors: Nicola Duca, Monthey (CH); Alexandre Boulle, Divonne-les-Bains (FR)

(73) Assignee: SICPA HOLDING SA, Prilly (CH)

( * ) Notice: Subject to any disclaimer, the term of this patent is extended or adjusted under 35 U.S.C. 154(b) by 242 days.

(21) Appl. No.: 15/766,988

(22) PCT Filed: Oct. 5, 2016

(86) PCT No.: PCT/EP2016/073746
§ 371 (c)(1),
(2) Date: Apr. 9, 2018

(87) PCT Pub. No.: WO2017/060275
PCT Pub. Date: Apr. 13, 2017

(65) Prior Publication Data

US 2019/0061359 A1 Feb. 28, 2019

(30) Foreign Application Priority Data

Oct. 8, 2015 (EP) ..... 15189032

(51) Int. Cl.
*B41J 2/17* (2006.01)
*B41J 2/175* (2006.01)
*B67D 7/02* (2010.01)

(52) U.S. Cl.
CPC ..... *B41J 2/17506* (2013.01); *B41J 2/1754* (2013.01); *B41J 2/17523* (2013.01); *B41J 2/17553* (2013.01); *B67D 7/02* (2013.01)

(58) Field of Classification Search
CPC .. B41J 2/17506; B41J 2/17523; B41J 2/1754; B41J 2/17553; B67D 7/02
(Continued)

(56) References Cited

U.S. PATENT DOCUMENTS 4,785,858 A * 11/1988 Valentini ..... A61J 1/2096 141/27
5,477,895 A * 12/1995 Willard ..... G01F 11/282 141/22

(Continued)

FOREIGN PATENT DOCUMENTS

CN 1612810 5/2005
CN 201143793 11/2008

(Continued)

OTHER PUBLICATIONS

Chinese Office Action in counterpart Chinese Application No. 201680058522.4 dated May 8, 2019 (and English language translation of the Office Action).

(Continued)

*Primary Examiner* — Timothy L Maust
(74) *Attorney, Agent, or Firm* — Muncy, Geissler, Olds & Lowe, P.C.

(57) ABSTRACT

A storage unit for storing a fluid, the storage unit comprising at least one wall defining a chamber and an opening. The storage unit comprises a storage unit valve arranged at the opening to selectively seal the chamber. The storage unit valve is able to be selectively opened and closed to allow fluid to flow through the storage unit valve. The storage unit comprises a storage unit keying mechanism configured to allow the storage unit to only connect to a complementary docking station keying mechanism disposed on a docking station for receiving the storage unit. The storage unit valve is configured to only be able to be selectively opened and closed when the storage unit keying mechanism is engaged with said complementary docking station keying mechanism.

17 Claims, 14 Drawing Sheets

(58) Field of Classification Search
USPC ..... 141/319, 384
See application file for complete search history.

(56) References Cited

U.S. PATENT DOCUMENTS

| | | | | |
|---|---|---|---|---|
| 5,641,012 | A * | 6/1997 | Silversides | A01C 15/006 137/846 |
| 5,732,751 | A * | 3/1998 | Schmidt | B41J 2/17506 141/2 |
| 5,734,401 | A * | 3/1998 | Clark | B41J 2/17506 347/86 |
| 5,796,419 | A * | 8/1998 | Clark | B41J 2/175 251/149.6 |
| 5,856,839 | A * | 1/1999 | Aukstikalnis | B41J 2/17513 347/86 |
| 6,116,719 | A | 9/2000 | Maza | |
| 6,585,016 | B1 * | 7/2003 | Falligant | A61M 16/183 141/352 |
| 7,458,665 | B2 | 12/2008 | Batista et al. | |
| 7,784,504 | B2 * | 8/2010 | Freed | A61M 16/183 141/301 |
| 9,592,675 | B2 * | 3/2017 | Matsumoto | B41J 2/17506 |
| 10,112,399 | B2 | 10/2018 | Kudo et al. | |
| 2004/0104984 | A1 * | 6/2004 | Hall | B41J 2/17506 347/86 |
| 2006/0152557 | A1 | 7/2006 | Silverbrook et al. | |
| 2013/0078025 | A1 | 3/2013 | Turgeman et al. | |
| 2013/0292592 | A1 | 11/2013 | Py | |

FOREIGN PATENT DOCUMENTS

| | | |
|---|---|---|
| CN | 102971157 | 3/2013 |
| CN | 103568581 | 2/2014 |
| CN | 104718407 | 6/2015 |
| JP | 2013123803 | 6/2013 |

OTHER PUBLICATIONS

International Search Report and Written Opinion issued with respect to application No. PCT/EP2016/073746.

* cited by examiner

SECURE REFILL SYSTEM

FIELD OF THE INVENTION

The present invention relates generally to a secure refilling system, and more particularly to a secure ink refilling system which prevents the tampering and theft of ink.

BACKGROUND OF THE INVENTION

When printing, it is necessary to refill a printer ink reservoir with ink after the ink in the printer ink reservoir is extinguished. In order to perform this refilling operation, it is necessary to transport ink from an ink manufacturing site or ink storage depot to the production printing facility, which transportation is usually effected by means of storing ink in an ink cartridge. This ink cartridge is then mounted onto a receptacle of the printer in order to refill the printer ink reservoir by transferring the ink inside the ink cartridge into the printer ink reservoir.

In some instances, for example when printing bank notes, the production printing facility requires the use of a security ink which may be used to signify the authenticity of the bank note. Ink cartridges containing security ink may be targeted by counterfeiters of bank notes for tampering or theft.

Similarly, printers configured to print with this security ink may be the target of theft or tampering by counterfeiters in order to gain access to the security ink present in the printer ink reservoir. Still further, counterfeiters may attempt to introduce counterfeit ink into the printer ink reservoir.

Similar problems may arise during the transfer and/or refill of other valuable or hazardous substances from one storage unit to another. For example, fuel stored in fuel storage units may be the target of theft. Other high-value or restricted substances may also be the target of theft during transit or transfer.

There is therefore a need for a new and improved secure refilling system which would effectively overcome the disadvantages as outlined above. Specifically, a particular need exists for a secure refilling system that would effectively restrict access to a high-value or hazardous substance contained in both a storage unit and the reservoir into which the substance is to be transferred.

SUMMARY OF THE INVENTION

Accordingly, the preferred embodiments of the present invention provide for a refilling system that avoids the above-mentioned drawbacks.

According to a first aspect of the present invention, there is provided a storage unit for storing a fluid, the storage unit comprising: at least one wall, the at least one wall defining a chamber; an opening; a storage unit valve arranged at the opening to selectively seal the chamber, the storage unit valve being able to be selectively opened and closed to allow fluid to flow through the storage unit valve; and a storage unit keying mechanism configured to allow the storage unit to only connect to a complementary docking station keying mechanism disposed on a docking station for receiving the storage unit; wherein the storage unit valve is configured to only be able to be selectively opened and closed when the storage unit keying mechanism is engaged with said complementary docking station keying mechanism, preferably wherein the storage unit is an ink cartridge.

The storage unit keying mechanism may be movable relative to the storage unit valve to open or close the storage unit valve. The storage unit keying mechanism may be configured to move in response to movement of said docking station keying mechanism during engagement of the storage unit keying mechanism to said docking station keying mechanism.

By utilising the same component to both perform the keying function and actuate opening and closing of the storage unit valve, the number of parts of the storage unit is reduced, thereby simplifying the manufacture of the storage unit and reducing manufacturing costs. Furthermore, the difficulty of tampering with the storage unit to obtain access to the contents is increased.

The storage unit keying mechanism may comprise a casing having one or more protrusions configured to engage with complementary slots formed in said docking station keying mechanism.

Provision of a storage unit keying mechanism to docking station keying mechanism engagement using slots and protrusions allows for a simple, robust keyed engagement to be formed between the storage unit and the docking station.

The storage unit keying mechanism may comprise an inner ring disposed within the casing and around the storage unit valve, the inner ring being configured to rotate around the storage unit valve, wherein rotation of the inner ring relative to the storage unit valve is configured to open or close the storage unit valve.

Provision of a keying mechanism that utilises rotation of a separate component disposed around the storage unit valve to open and close the storage unit valve allows for the storage unit valve and keying mechanism to be formed in a compact, non-bulky manner, thereby reducing the difficulty of forming the engagement between the storage unit and the docking station by an operator. Furthermore, the difficulty of tampering with the storage unit to obtain access to the contents is increased.

The storage unit valve may comprise one or more pins, said pins being slidably disposed within an angled slot formed in the inner ring such that rotational movement of the inner ring causes an axial movement of the pins, and wherein the axial movement of the pins is configured to open or close the storage unit valve.

Provision of one of more pins on the storage unit valve allows for a robust and reliable cam-like mechanical system to be used to open and close the storage valve during keyed engagement with the docking station.

The angled slot may comprise a parallel slot extending parallel to a central axis of the inner ring, a circumferential slot extending circumferentially to the central axis of the inner ring, and a slot connecting the parallel and circumferential slots.

An angled slot as detailed above allows for the prevention of multiple cycles of opening and closing the storage unit valve, as shall be detailed below. Preventing multiple cycles of opening and closing the storage unit valve limits access to the contents of the storage unit after a single use, and therefore reduces the possibility of theft or tampering of any residual content of the storage unit left in the storage unit after transferring the contents of the storage unit into a reservoir.

The storage unit may comprise an opening ratchet mechanism configured to only allow the storage unit valve to be opened from a fully closed state until the storage unit valve is in a fully open state.

Use of a ratchet mechanism to prevent only a partial opening of the storage unit valve before the storage unit valve can be closed ensures that all or most of the contents of the storage unit are likely to be transferred out of the storage unit before the storage unit is subsequently sealed.

This reduces the likelihood of a large amount of residual content being retained in the storage unit after transfer of the contents, thereby reducing the likelihood that the contents of the storage unit will be stolen or tampered with after the transfer operation has been completed.

The storage unit may comprise a closing ratchet mechanism configured to only allow the storage unit valve to be closed from a fully open state until the storage unit valve is in a fully closed state.

Use of a ratchet mechanism to prevent only a partial closure of the storage unit valve before opening the storage unit valve further reduces access to the contents of the storage unit, thereby reducing the likelihood that the contents will be stolen or tampered with after the transfer operation.

The storage unit keying mechanism may be configured to prevent disengagement of the storage unit keying mechanism from the docking station keying mechanism unless the storage unit valve is fully closed.

Preventing disengagement of the storage unit keying mechanism from the docking station keying mechanism unless the storage unit valve is closed reduces the accessibility of the contents of the storage unit, thereby reducing the likelihood of theft or tampering of these contents.

The opening ratchet mechanism and/or the closing ratchet mechanism may be single-use, such that the storage unit valve can only be adjusted from a fully closed state to a fully open state once and/or from a fully open state to a fully closed state once.

Provision of a single use valve allows for any residual amount of the substance stored inside the storage unit to be securely retained inside the storage unit after transfer of the contents. Securely retaining any residual amount of the substance within the storage unit reduces the likelihood of theft or tampering of this substance.

The storage unit may comprise an indicator configured to indicate whether the storage unit valve has been in an open state.

Provision of an indicator configured to indicate whether the storage unit valve has been in an open state allows for a quick determination of whether the storage unit contents have been transferred out of the storage unit. As such, an authorised person or automated system can quickly determine whether a storage unit has been improperly emptied of its contents. Furthermore, an indicator showing whether the storage unit valve has been in an open state allows for an operator to quickly determine whether a particular storage unit is empty, thereby improving the ease of performing multiple refilling operations of a reservoir. The storage unit itself may be single-use, as shall be detailed below.

The at least one wall of the storage unit may be formed of a metal and/or a tough plastic. In this specification, a tough plastic should be understood as a plastic that cannot easily be punctured or broken.

Forming the wall of the storage unit out of a metal or a tough plastic reduces the likelihood of a storage unit being broken open to access the contents inside, thereby preventing the likelihood of theft or tampering of the contents of the storage unit. The material used to form the wall of the storage unit is preferably non-reactive with the contents of the storage unit.

In a second aspect of the present invention, there is provided a docking station for receiving a storing unit, the docking station comprising: a docking station keying mechanism configured to engage with a complementary storage unit keying mechanism; and a docking station valve is configured to selectively open or close to selectively seal a flow path through the docking station; wherein the docking station valve is configured to selectively open or close only when the docking station keying mechanism is engaged with said complementary storage unit keying mechanism, preferably wherein the docking station is part of a printer.

Movement of the docking station keying mechanism may be configured to selectively open and close the docking station valve.

The docking station may comprise a stopping mechanism configured to prevent movement of the docking station keying mechanism unless a storage unit keying mechanism is in engagement with the docking station keying mechanism.

Provision of a stopping mechanism configured to prevent opening or closing of the docking station valve unless a storage unit keying mechanism is in engagement with the docking station keying mechanism prevents the docking station valve being opened without a storage unit attached to the docking station, thereby preventing access through the docking station to a reservoir disposed behind the docking station containing high value or hazardous substances, thereby reducing the likelihood of theft of tampering of these substances.

The docking station may comprise a docking station indicator configured to indicate whether the docking station valve is in an open state or a closed state.

Provision of a docking station indicator to indicate whether the docking station valve is in an open or closed state increases the ease of the refilling operation for an operator.

The docking station indicator may be positioned to visually aid an operator in engaging the storage unit keying mechanism with the docking station keying mechanism.

Positioning the indicator in this manner increases the ease of the refilling operation for the operator.

The docking station keying mechanism may be configured to prevent disengagement of the docking station keying mechanism with the storage unit keying mechanism unless the docking station valve is in a fully closed state.

Preventing disengagement of the docking station keying mechanism with the storage unit keying mechanism unless the docking station valve is closed reduces the accessibility of the contents through the docking station valve, thereby reducing the likelihood of theft or tampering of these contents.

According to a third aspect of the present invention, there is provided a system comprising any storage unit as detailed above and any docking station as detailed above.

According to a fourth aspect of the present invention, there is provided a method of connecting a storage unit to a docking station, the method comprising the steps of: engaging the storage unit with the docking station by coupling a storage unit keying mechanism on the storage unit to a docking station keying mechanism on the docking station, moving the docking station keying mechanism to simultaneously open a storage unit valve and a docking station valve, thereby allowing fluid transfer from the storage unit into the docking station; moving the docking station keying mechanism to simultaneously close the storage unit valve and the docking station valve, thereby preventing fluid transfer from the storage unit into the docking station; and disengaging the storage unit from the docking station by de-coupling the storage unit keying mechanism from the docking station keying mechanism.

The storage unit of this method may be the storage unit as detailed above. The docking station of this method may be the docking station as detailed above. This method may also prevent access to the contents of the storage unit during the fluid transfer operation.

Moving the docking station keying mechanism to simultaneously open a cartridge valve and a docking station valve may comprise rotating the docking station keying mechanism in one direction, and wherein moving the docking station keying mechanism to simultaneously close a cartridge valve and a docking station valve comprises rotating the docking station in the opposite direction.

BRIEF DESCRIPTION OF THE DRAWINGS

In order to better understand the present invention, and to show how the same may be carried into effect, reference will be made, by way of example only, to the following drawings, in which.

DETAILED DESCRIPTION

The following description illustrates some exemplary embodiments of the disclosed invention in detail. Those skilled in the art will recognise that there are numerous variations and modifications of this invention that are encompassed by the scope of the appended claims. Accordingly, the description of a certain exemplary embodiment should not be deemed to limit the scope of the present invention.

Figure 1:
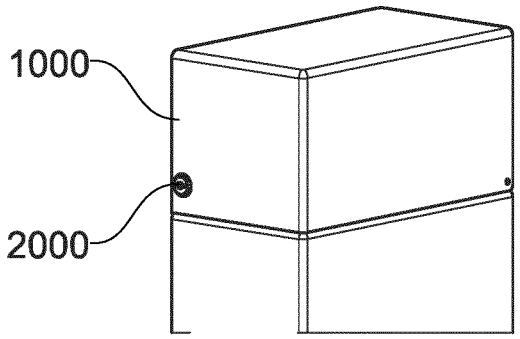
FIG. 1 shows a refill system covered by a cover to restrict access to the refill system.

FIG. 1 shows a refill system with a closed refill unit cover 1000. The refill unit cover may be lockable via a lock 2000 and may be swivel mounted.

Figure 2:
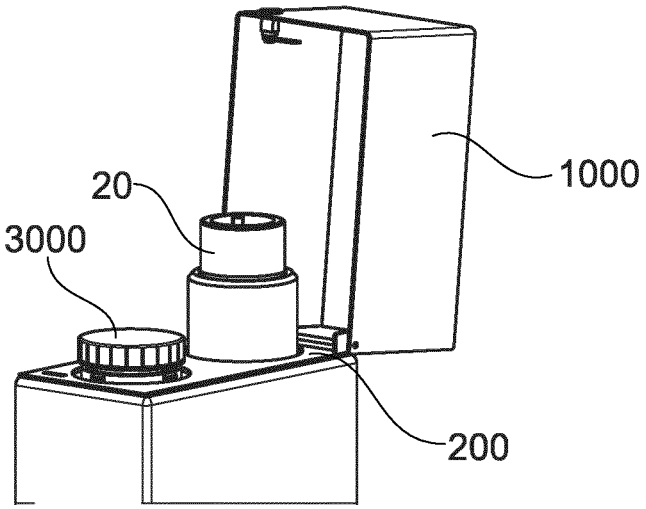
FIG. 2 shows a refill system with a lifted cover to allow access to the refill system.

FIG. 2 shows a refill system with an open refill unit cover 1000 and a docking station 20 mounted on a cabinet 200 of the refill system. The docking station 20 is suitable for receiving storage units in order to refill at least one fluid reservoir contained within the cabinet 200. The fluid reservoir may be part of a printer and be suitable for the storage of ink, for example a security ink. Further fluid reservoirs may also be included inside the cabinet, for example a solvent storage tank, which is shown with a screw cap 3000 in FIG. 2. The docking station 20 may be mounted to the cabinet 200 or directly to the top of the fluid reservoir inside the cabinet 200. In either case, the docking station 20 may be mounted in such a way to restrict access to the fluid reservoir. The docking station 20 may be formed integrally with the cabinet 200 or may be mounted to the cabinet 200 by any means of connection, such as by screws, or by welding or gluing.

Figure 3:
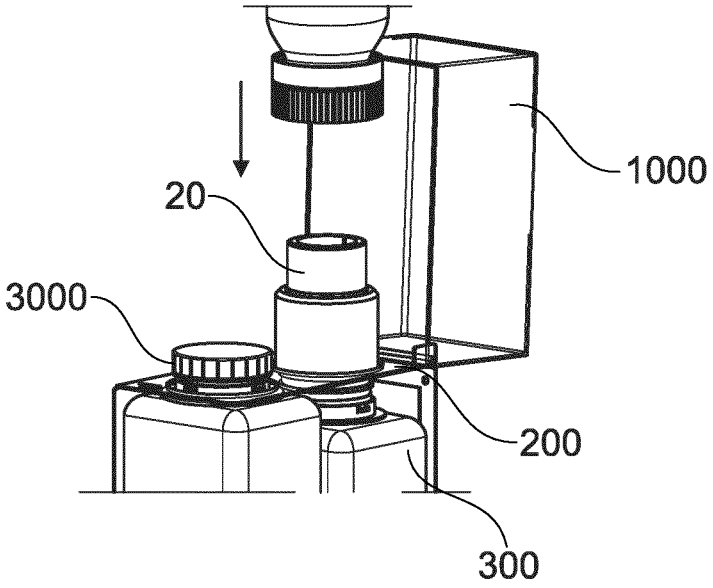
FIG. 3 shows a storage unit about to be loaded onto a docking station of the refill system.

FIG. 3 shows a cabinet 200 comprising a fluid reservoir 300. As can be seen from FIG. 3, a storage unit may be connected to the docking station in order to refill the fluid reservoir 300.

Figure 4:
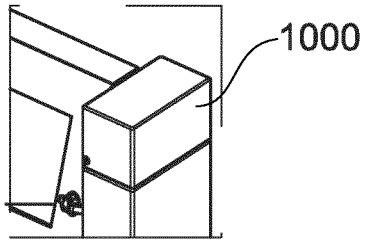
FIGS. 4 to 6 show refill systems with different cover shapes and positions.

FIG. 4 shows a refill cover lid 1000 with an elevated upper surface to accommodate the docking station mounted on the cabinet.

Figure 5:
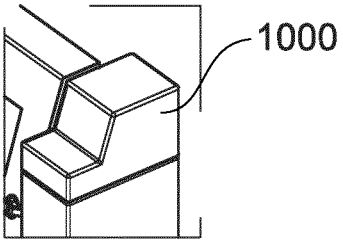

FIG. 5 shows a refill cover lid 1000 with a slanted or step-like upper surface to accommodate the connector assembly mounted on the cabinet.

Figure 6:
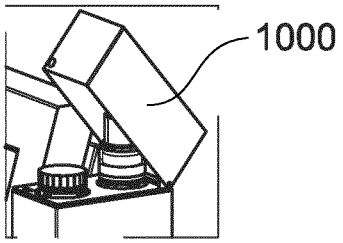

FIG. 6 shows an unlocked and opened refill cover lid 1000 with an exposed docking station 20 for receiving a storage unit.

Figure 7:
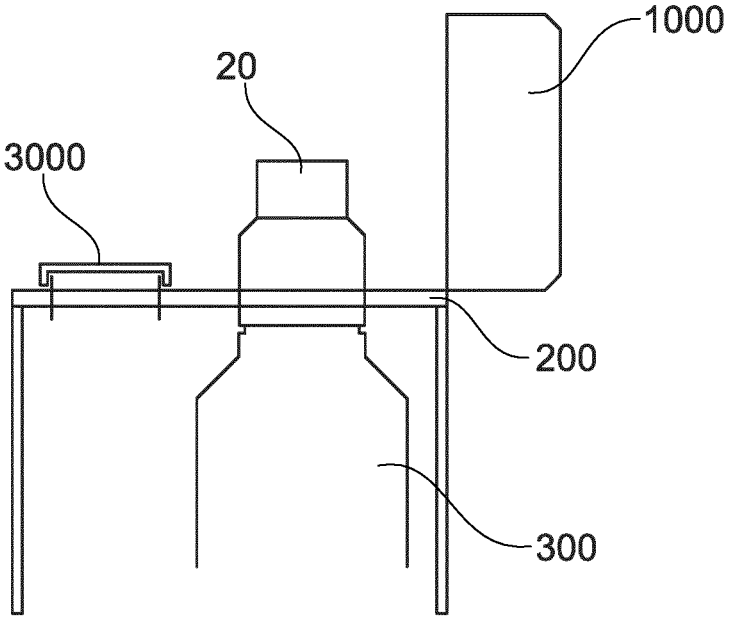
FIG. 7 shows a schematic drawing of a docking station mounted on the refill system.
Figure 8:
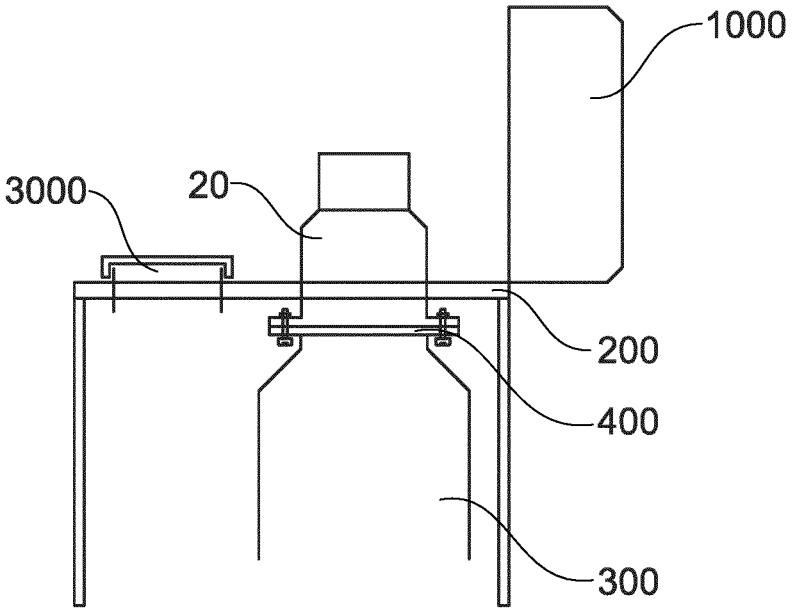
FIG. 8 shows another schematic drawing of a docking station mounted on the refill system.

FIGS. 7 and 8 show cross-sections of different ways of mounting the docking station to the reservoir, such as by integrally forming the docking station in FIG. 7 on the reservoir or through an intermediate plate 400 by screws in FIG. 8.

Figure 9:
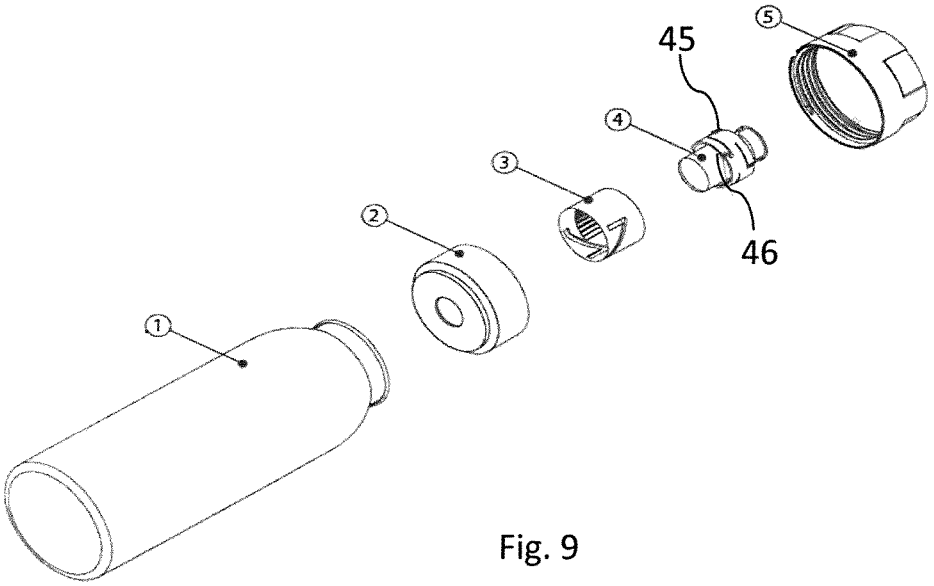
FIG. 9 shows an exploded view of a storage unit.

FIG. 9 shows a storage unit. The storage unit comprises a canister 1 having walls that define an interior storage chamber. At one end of the canister is an opening. A casing 2 for a storage unit valve is disposed at the opening. The casing 2 may be formed integrally with the canister, or may be attached to the canister by means of welding, friction fit, etc. A storage unit valve 4 is disposed at least partly within the casing 2. The storage unit valve 4 can be opened and closed and is disposed to seal the flow path through the opening of the canister 1 when closed, or allow fluid transfer out of the canister 1 when open. The storage unit valve 4 comprises an inner part and an outer part. The outer part of the storage unit valve may comprise a hollow body with protrusions projecting outwardly from the outer surface. A valve seat is formed within the outer part of the storage unit valve. The inner part of the storage unit valve 4 may be another body comprising pins 44 projecting outwardly from the body. In the closed position, the inner part of the storage unit valve is disposed on or in the valve seat of the outer part, thereby sealing the valve. Axial movement of the pins 44 of the inner part effects an axial movement of the inner part of the storage unit valve to move the inner part of the storage valve away from the valve seat and thereby open the storage unit valve.

Figure 14:
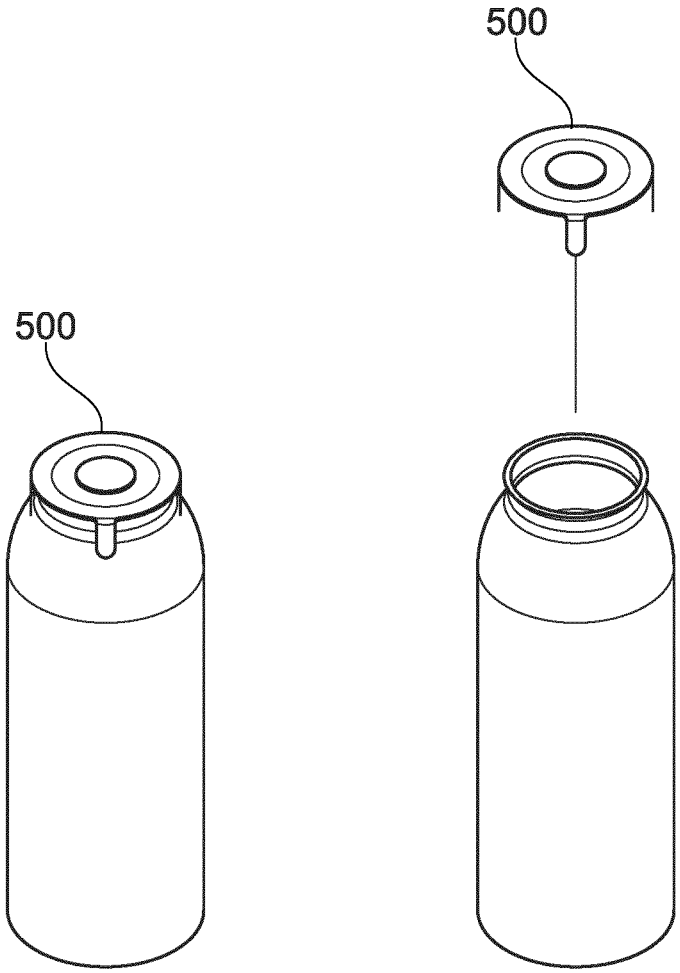
FIG. 14 shows a storage unit with a removable tamper-evident tab.
Figure 15:
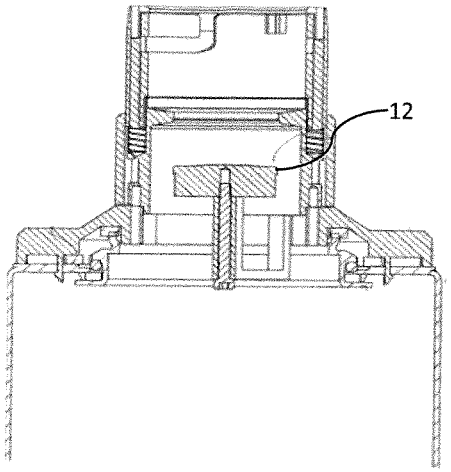
FIG. 15 shows a cross-section view of a docking station attached to a reservoir.

As shown in FIG. 14, a tamper evident tab 500 may cover the storage unit valve 4. The tamper evident tab 500 may be formed integrally with the casing 2 or may be attached to the casing 2 such that the tamper evident tab 500 is destroyed or cannot be re-attached to the casing 2 after removal. The tamper evident tab 500 therefore provides a visible trace if the integrity of the storage unit has been compromised, or if an unauthorised attempt to access the contents of the storage unit has occurred.

Figure 12:
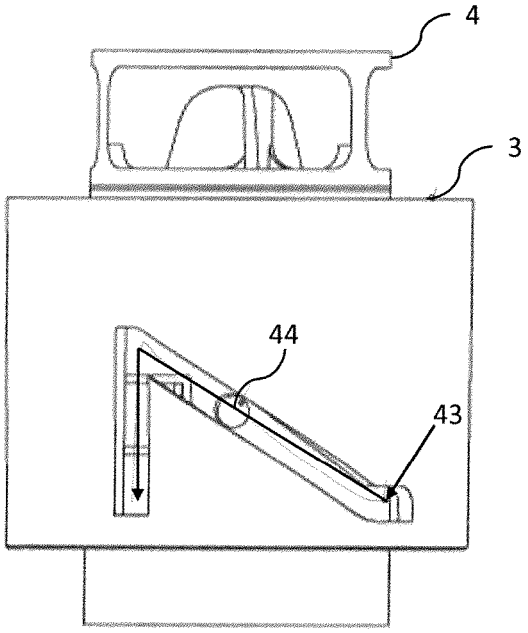
FIG. 12 shows a storage unit inner ring with an angled slot and a storage unit valve inside the inner ring.

Referring again to FIG. 9, an inner ring 3 is also disposed within the casing 2. The inner ring 3 is disposed co-axially around the storage unit valve 4 and is rotatable around the storage valve unit 4. The inner ring 3 may comprise an angled slot 43, as shown in FIG. 12. The function of the angled slot with respect to the pins 44 of the inner part of the storage unit valve 4 will be described below.

The pins 44 of the storage valve unit 4 are arranged inside the angled slot 43 formed in the inner ring 3. The angled slot 43 may comprise any slot that is not formed only perpendicular to the axis of the inner ring or only circumferentially around the inner ring. As shown in FIG. 12, the angled slot 43 preferably comprises a parallel slot extending parallel to the central axis of the inner ring; a circumferential slot extending circumferentially around the inner ring; and an angled slot connecting these parallel and circumferential slots.

In use, a rotational movement of the inner ring 3 causes an axial movement of the pins 44. Specifically, since the pins 44 are constrained to move within the angled slot 43 of the inner ring 3, rotation of the inner ring forces the pins to follow the path defined by the angled slot 43, which produces a resultant axial movement of the pins 44 to open or close the storage unit valve 4.

Figure 11A:
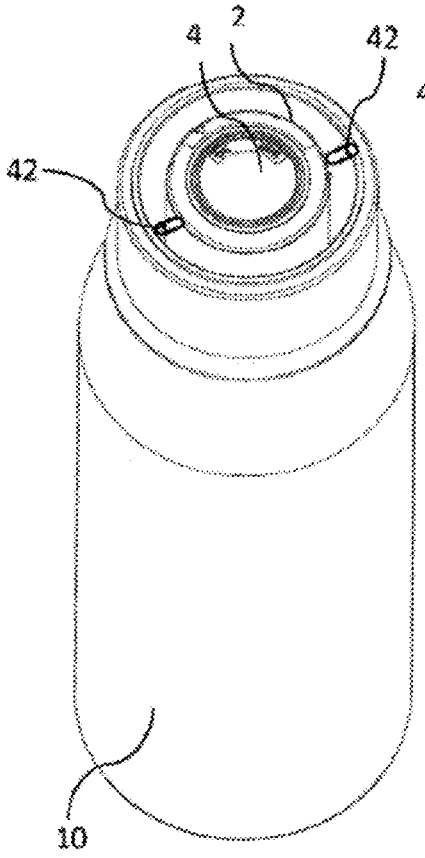
FIGS. 11*a* and 11*b* show storage units with indicators.
Figure 11B:
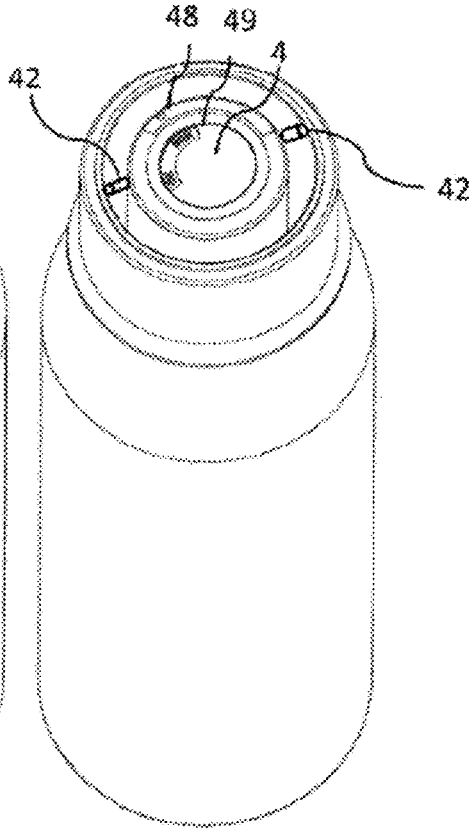

FIGS. 11*a* and 11*b* show another angle of the storage unit. As can be seen from these Figures, the casing 2 also comprises a keying mechanism. Specifically, these Figures show a keying mechanism comprising one or more protrusions 42. These protrusions 42 are arranged to form a keying mechanism such that the storage unit can form a keyed engagement with a complementary docking station, which shall be described below.

As also shown in FIGS. 11*a* and 11*b*, a circular gap is formed between the casing 2 of the storage unit valve 4 and the outer housing 5 of the storage unit. The circular gap is sized to allow a docking station inner ring to be introduced into this gap, as shall be detailed below.

One or more resilient clips are formed on the outer surface of the storage unit inner ring 3. The one or more resilient clips are configured to engage with sawtooth-like teeth formed on the interior surface of the casing 2 for the storage unit valve 4. As the storage unit inner ring 3 rotates, the clips on the storage unit inner ring 3 slide over the rising edge of the sawtooth-like teeth formed on the interior surface of the casing 2 for the storage unit valve 4. However, the storage unit inner ring 3 is prevented from rotating in the opposite direction because the clips on the storage unit inner ring 3 abut up against the vertical edge of the sawtooth-like teeth in the opposite direction. The one or more resilient clips and sawtooth-like teeth therefore form a ratchet mechanism to prevent rotation of the inner ring 3 in a reverse direction.

Figure 13:
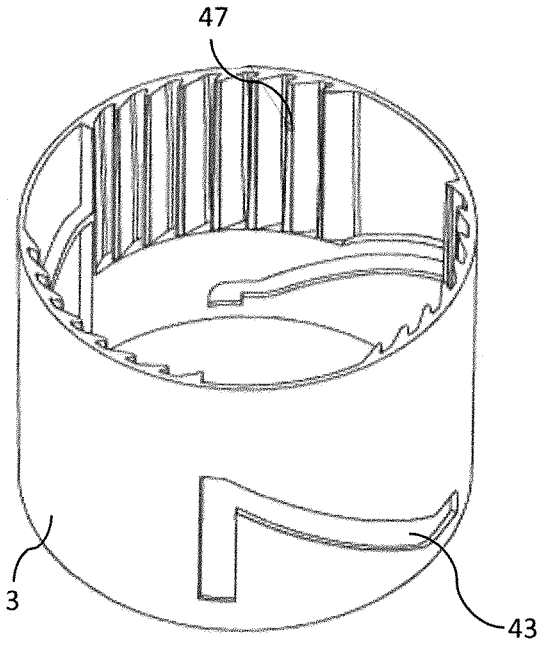
FIG. 13 shows a tilted view of a storage unit inner ring.

Similarly, one or more resilient clips are formed on the outer surface of the outer part of the storage unit valve 4. The one or more resilient clips are configured to engage with sawtooth-like teeth 47 formed on the interior surface of the storage unit inner ring 3, as shown in FIG. 13. As the outer part of the storage unit valve 4 rotates, the clips on the storage unit valve 4 slide over the rising edge of the sawtooth-like teeth 47 formed on the interior surface of the storage unit inner ring 3. However, the storage unit valve 4 is prevented from rotating in the opposite direction because the clips on the storage unit valve 4 abut up against the vertical edge of the sawtooth-like teeth 47 in the opposite direction. The one or more resilient clips on the storage unit valve and the sawtooth-like teeth 47 on the interior surface of the storage unit inner ring 3 therefore form a ratchet mechanism to prevent rotation of the valve assembly in a reverse direction. How these ratchet mechanisms operate in a refilling operation shall be described below.

Figure 10:
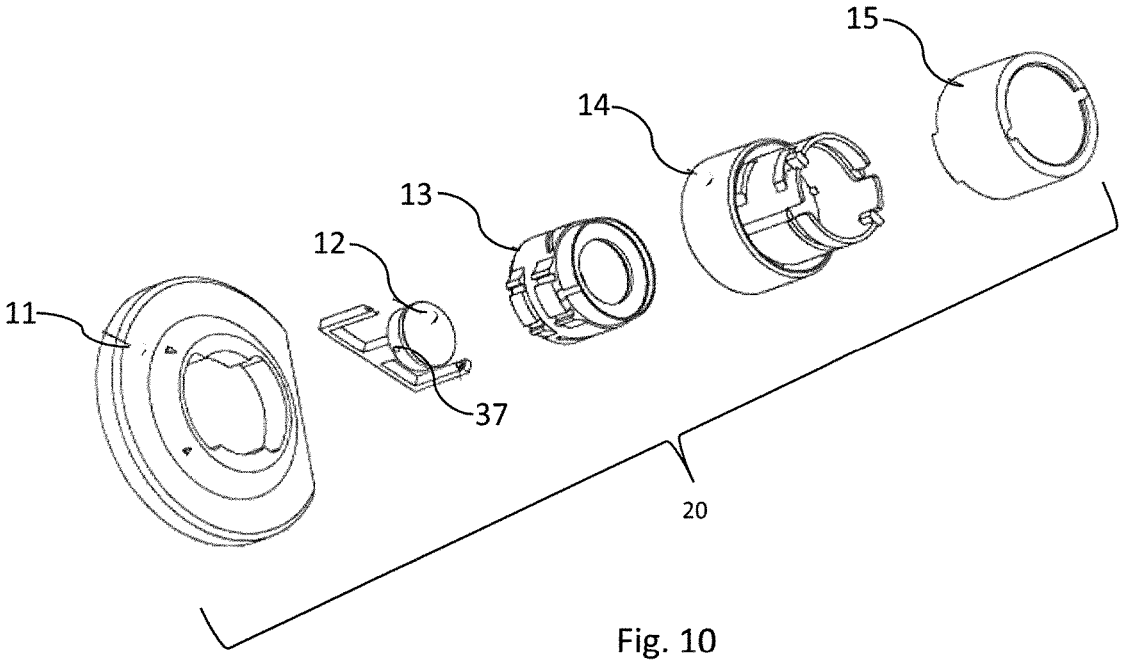
FIG. 10 shows an exploded view of a docking station.

FIG. 10 shows a docking station 20 configured to receive the storage unit shown in FIG. 9. The docking station 20 comprises a mechanical interface 11 comprising a fluid flow path therethrough. The mechanical interface 11 is preferably configured to interface with a cabinet comprising a storage reservoir such that substances passing through the flow path mechanical interface are deposited in the reservoir. For example, the mechanical interface of the docking station may be attached to a printer in such a way that ink passing through the flow path of the mechanical interface is deposited in an ink reservoir of the printer. Alternatively, the docking station may be attached to a fuel reservoir in such a way that fuel passing through the flow path of the mechanical interface is deposited in the fuel reservoir. The mechanical interface may be attached to the reservoir by welding, for example. Alternatively, the mechanical interface may be joined to the reservoir with screws, rivets, hooks, clips or other attachments, or may be formed integrally with the reservoir.

Figure 17:
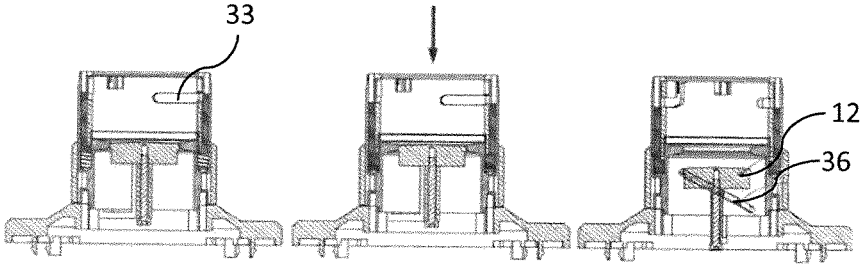
FIG. 17 shows cross-sections of a docking station.
Figure 18:
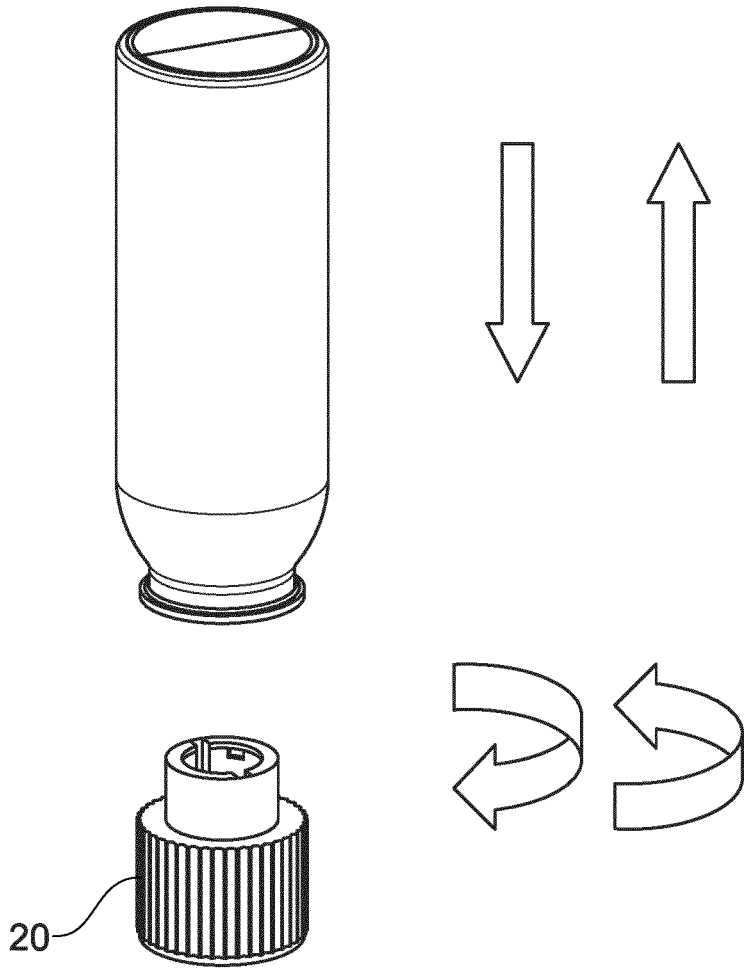
FIG. 18 shows the movements required to mount and open a storage unit on the docking station.

The docking station 20 further comprises a docking station valve 12 arranged to selectively seal the flow path through the mechanical interface 11. The docking station valve 12 comprises pins 37. Axial movement of the pins 37 opens and closes the docking station valve 12. Disposed about the docking station valve 12 is a docking station inner ring 13. As shown in FIG. 17, the docking station inner ring 13 comprises an angled slot 36. The pins 37 of the docking station valve 12 are disposed in the slot 36 of the docking station inner ring 13. The docking station inner ring 13 is configured to rotate about the docking station valve 12. When the docking station inner ring 13 rotates in a first direction, the pins 37 of the docking station valve 12 are constrained to move along the angled slot 36 of the docking station inner ring 13. Rotation of the docking station inner ring 13 therefore causes an axial movement of the pins 37 to open the docking station valve 12. Similarly, rotation of the docking station inner ring 13 in an opposite direction to the first direction effects an axial movement of the pins 37 to close the docking station valve 12.

Disposed about the docking station inner ring 13 is an activation ring 14 directly or indirectly connected to the docking station inner ring 13 such that rotation of the activation ring 14 causes rotation of the docking station inner ring 13. An outer housing 15 is disposed about at least a part of the activation ring 14.

Figure 16A:
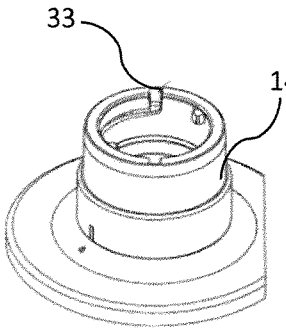
FIGS. 16*a* to 16*c* show a docking station comprising an activation ring with locking slots.
Figure 16B:
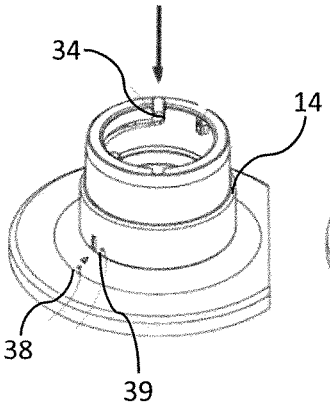
Figure 16C:
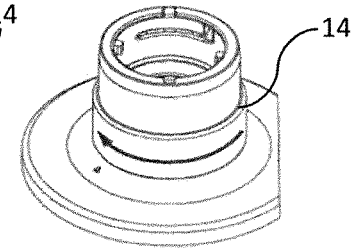

As shown in FIGS. 16*a* to 16*c*, the activation ring 14 further comprises one or more locking slots 33 arranged to receive the above-mentioned protrusions 42 arranged on the casing 2 of the storage unit. The locking slots are preferably L-shaped. The arrangement and size of the locking slots 33 are selected such that the locking slots 33 can only receive complementary arranged and sized protrusions 42. A keying system is therefore established between the docking station 20 and the storage unit. Specifically, only storage units having a predetermined arrangement of correctly sized protrusions 42 on the casing 2 can be received into the slots 33 of the activation ring 14 of the docking station. Once the protrusions 42 are received into the slots 33 of the activation ring 14, an engagement between the storage unit and the docking station is formed. The terms "engagement" and "engage" should be understood as describing an operative connection between the storage unit keying mechanism and the docking station keying mechanism.

The docking station 20 may also comprise a locking mechanism to prevent rotation of the activation ring 14 unless a storage unit is in engagement with the docking station 20. One example of a locking mechanism is shown in FIG. 16*b* in the form of resilient tabs 34 on the outer housing 15, the resilient tabs 34 being disposed in use to protrude into the slots 33 to prevent the activation ring 14 from rotating. When a storage unit is introduced vertically into the docking station 20, the protrusions 42 arranged on the casing 2 of the storage unit force the resilient tabs 34 away from the slots 33 such that the activation ring 14 is free to rotate. As shown in FIGS. 16*a* to 16*c*, the slots 33 of the activation ring 14 may be formed substantially in an L-shape. The protrusions 42 arranged on the casing 2 of the storage unit are constrained to move within the locking slots 33.

The operation of depositing a substance inside the storage unit through the docking station 20 will now be described.

In use, an operator unlocks the refill unit cover 1000 to gain access to the docking station 20. The operator then pulls off the tamper evident tab 500 covering the storage unit valve 4 to expose the protrusions 42 present on the outer housing 5 of the storage unit. The operator then forms an engagement between the storage unit into the docking station 20 by introducing the protrusions 42 disposed on the outer housing 5 of the storage unit into the complementary slots 33 of the activation ring 14 as shown in FIG. 16*b*. The introduction of the protrusions 42 into the slots 33 forces the resilient tabs 34 away from the slots 33, thereby allowing free rotational movement of the activation ring 14. The inner ring 13 of the docking station 20 is arranged to fit into the circular gap formed between the casing 2 of the storage valve assembly 4 and the outer housing 5 of the storage valve assembly 4. The engagement between the docking station 20 and the storage unit also causes the activation ring 14 to engage with the storage unit inner ring 3 such that rotation of the activation ring 14 causes rotation of the storage unit inner ring 3.

The operator then rotates the activation ring 14 in a first direction. The rotational movement of the activation ring 14 simultaneously causes both the docking station valve 12 and the storage unit valve 4 to open, as detailed below.

The rotational movement of the activation ring 14 as it is turned by the operator forces the pins 37 on the docking station valve 12 to move within the slot 36 formed in the docking station inner ring 13. As detailed above, the movement of the pins 37 within the slot 36 causes an axial movement of the pins 37, which causes the docking station valve 12 to open.

Simultaneously, the rotational movement of the activation ring 14 as it is turned by the operator also causes a concurrent rotation in the storage unit inner ring 3. As the storage unit inner ring 3 turns, the rotational movement forces pins 44 of the storage unit valve 4 to move within the slot 43 of the storage unit inner ring 3. Specifically, the slots 43 are constrained to move along the circumferential slot and then the angled connecting slot of the angled slot 43 of the storage unit inner ring 3 as shown in FIG. 12. As detailed above, the movement of the pins 44 within the slot 43 causes a resultant axial movement of the pins 44, which causes the storage unit valve 4 to open. When the storage unit valve 4 is open, the contents of the storage unit can flow out of the storage unit under the influence of gravity through the storage unit valve 4, through the open docking station valve 12 and through the flow path defined in the mechanical interface 11 of the docking station 20. The contents may flow into a reservoir, as detailed above.

As the activation ring 14 is rotated, the protrusions 42 on the casing 2 of the storage unit traverse the horizontal section of the locking slots 33 formed in the activation ring 14. The storage unit is therefore held in engagement with the activation ring 14 during rotation of the activation ring 14, such that the storage unit cannot be disengaged from the activation ring 14 when the docking station valve 12 is open due to the activation ring 14 being rotated.

Furthermore, as the activation ring 14 is rotated, the opening ratchet mechanism on the storage unit is activated. Specifically, clips on the radially outer surface of the storage unit inner ring 3 slide over a series of sawtooth-like teeth disposed on the inner surface of the casing 2. The clips may move over the teeth in one direction, but are prevented from moving over the teeth in the reverse direction because of the vertical walls of the teeth. The operator may therefore rotate the storage unit inner ring 3 to open the storage unit valve 4, but cannot rotate the storage unit inner ring 3 in the opposite direction to close the storage unit valve 4. The operator must therefore continue to turn the activation ring 14 in one direction to fully open the storage unit valve 4. When the storage unit valve 4 is in a fully open position, the pins 44 of the storage unit valve will be disposed in the angled slot 43 of the storage unit inner ring 3 at the intersection of the angled connecting part of the slot and the slot extending parallel to the axis of the storage unit inner ring, as shown in FIG. 12.

The closing operation will now be described.

After the contents of the storage unit have flowed out of the storage unit and through the flow path defined in the mechanical interface 11 of the docking station 20, the operator can disengage the storage unit from the docking station 20. The operator first rotates the activation ring 14 in the opposite direction to the first direction of the refiling operation.

The rotational movement of the activation ring 14 as it is turned in a reverse direction by the operator forces the pins 37 on the docking station valve 12 to move within the slot 36 formed in the docking station inner ring 13. As detailed above, the movement of the pins 37 within the slot 36 causes an axial movement of the pins 37, which causes the docking station valve 12 to close.

Simultaneously, the rotational movement of the activation ring 14 as it is turned by the operator in the reverse direction also causes a concurrent rotation in the outer part of the storage unit valve 4. The storage unit inner ring 3 cannot rotate in the opposite direction, as it is prevented from rotating in the reverse direction by the opening ratchet mechanism, as detailed above. As the second part of the storage unit valve 4 rotates, the rotational movement forces pins 44 of the storage unit valve 4 to move within the slot 43 of the storage unit inner ring 3. Specifically, the rotational movement of the second part of the valve assembly causes the pins 44 to move along the part of the angled slot extending parallel to the axis of the storage unit inner ring 3, as shown in FIG. 12. As detailed above, the movement of the pins 44 within the slot 43 causes an axial movement of the pins 44, which causes the storage unit valve 4 to close.

Furthermore, as the activation ring 14 is rotated, the closing ratchet mechanism is activated. Specifically, clips on the radially outer surface of the second part of the storage unit valve slide over a series of sawtooth-like teeth 47 disposed on the inner surface of the storage unit inner ring 3. The clips may move over the teeth 47 in one direction, but are prevented from moving over the teeth 47 in the reverse direction because of the walls of the teeth. The operator may therefore rotate the second part of the storage valve 4 to close the storage unit valve 4, but cannot rotate the second part of the storage unit valve 4 in the opposite direction to open the storage unit valve 4. The operator must therefore continue to turn the activation ring 14 in one direction to fully close the storage unit valve 4. The closing ratchet mechanism also prevents the storage unit valve 4 being opened a second time. As such, the storage unit valve 4 is single use.

As the operator rotates the activation ring 14 to simultaneously close both the storage unit valve 4 and the docking station valve 12, the protrusions 42 of the casing 2 of the storage unit traverse the horizontal parts of the locking slot groove of the activation ring 14 in the opposite direction. At the end of the rotational movement, the storage unit valve 4 and the docking station valve 12 are both fully closed and the protrusions 42 of the casing 2 line up with the vertical parts of the slots 33 of the activation ring 14. Only when the docking station valve and the storage unit valve 4 are fully closed can the operator lift the storage unit vertically to disengage the storage unit from the docking station 20.

Figure 19:
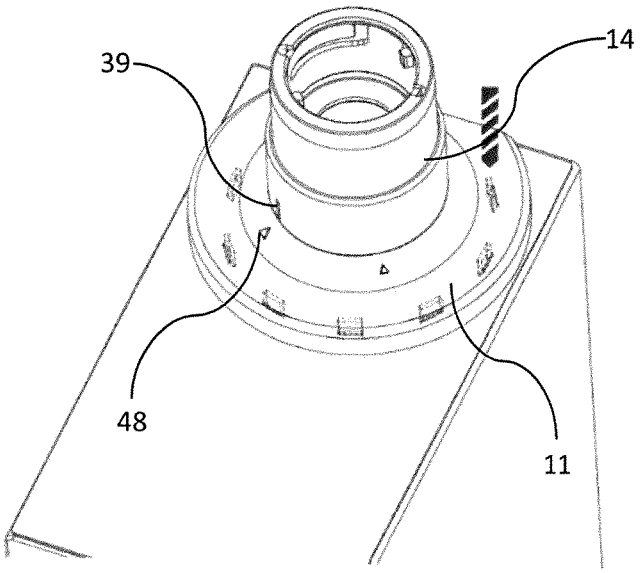
FIG. 19 shows a docking station with indicators.

To assist the operator in performing the opening and closing operations required for dispensing the contents of the storage unit through the docking station 20 indicators are provided on the docking station. The indicators may be provided on the mechanical interface 11 and the activation ring 14, as shown in FIG. 19. For example, an arrow 48 may be provided on the mechanical interface 11 and a mark 39 may be provided on the activation ring, which mark 39 is aligned with the arrow 48 when the docking station valve is closed. When the activation ring is turned, the mark 39 moves out of alignment with the arrow 48 to indicate to the observer that the docking station valve 12 is open. When the docking station valve 12 is closed, the mark 39 and the arrow 48 preferably line up with the vertical part of the locking slot groove of the activation ring 14 such that the operator can line up the protrusions 42 on the casing 2 with the mark 39 and the arrow 48 in order to guide the operator in introducing the protrusions 42 into the vertical slots of the locking slot groove of the activation ring 14.

A second pair of indicators may be provided on the storage unit in order to allow the operator to determine quickly whether the storage unit has been opened. As shown in FIGS. 11*a* and 11*b*, these indicators may take the form of an arrow disposed on the top surface casing 2 for the storage unit valve 4 and the letters "OK" and "NOK" provided on the top surface of the storage unit valve 4. When the storage unit valve has not been opened, the arrow on the top surface of the casing is aligned with the letters "OK", as shown in FIG. 3*a*. After the storage unit valve has been opened, the arrow on the top surface of the casing 2 is aligned with the letters "NOK", as shown in FIG. 11*b*. The cycle of opening and closing the storage unit valve 4 will cause the position of the arrow on casing 2 to change with respect to the letters "OK" and "NOK" on the storage unit valve 4. At the start of the cycle, the arrow will line up with the letters "OK" to indicate that the storage unit is ready to use. At the end of the cycle, the arrow will line up with the letters "NO" to indicate that the storage unit has been used and cannot be used a second time because the clips on the storage unit valve are locked in the closed position by the teeth 47 disposed on the storage unit inner ring 3. Alternatively, the letters "NOK" may be omitted, and the arrow being out of alignment with the letters "OK" may indicate that the storage unit has been used.

Modifications

Several alternatives and modifications to the above example are envisaged.

The above describes the activation ring 14 of the docking station 20 as being manually rotatable by an operator. However, the activation ring 14 may also be automated, and be driven by a motor, for example. Alternatively, an industrial robot may perform the refilling operation.

Similarly, the above describes a mechanical stopping mechanism arranged to prevent the activation ring 14 from rotating unless a storage unit has been introduced into the docking station. However, the stopping mechanism can be electrical instead of mechanical. For example, an electromechanical actuator or latch could release the docking station from a locked state when a signal from an RFID antenna or electrical signal included on the storage unit is detected by a receiver disposed at or near the docking station 20 when the storage unit is inserted into the docking station. The receiver would be at least electrically coupled to the electromechanical actuator or latch.

Although the figures are directed to the storage unit being an ink cartridge and the docking station being attached to an ink reservoir in a printer, the same engagement system could equally be used to connect two tubes or pipes.

Although the above describes a liquid substance flowing out of the storage unit and through the docking station under the influence of gravity, another means may be used to transfer a substance out of the storage unit and through the docking station. For example, a pump, a vacuum system, a capillary feature, a thermal or a piezo force or another mechanism may be used to facilitate this fluid transfer.

Although the above describes a preferred embodiment of an activation ring with locking slots formed in an L-shape, the activation ring may also have a bayonet-type fitting.

Although the open/close indicators on the docking station and the storage unit are described above as mechanical, these indicators may be electronic.

Instead of using a ratchet mechanism to provide the single use function of the storage unit valve, this single use function may instead be provided through the use of an motor-actuated locking member, or a spring actuated locking member where a blocking member is arranged to spring or otherwise move into a blocking position after the open/close cycle of the storage unit valve such that the blocking member in the blocking position prevents movement of the storage unit valve from a closed position.

The storage unit and docking station of FIGS. 9 and 10 may be used in a variety of applications involving the transfer and/or refill of various substances from one container to another wherein the substances require protection from unauthorized access either because they are hazardous or because their value makes them a target of theft or misuse.

Neither are the described embodiments limited to the storage and transfer of liquids; it is equally applicable for use with materials in any phase in which it can flow such as gaseous, fluid, solid or powder. In addition to ink, such materials could be substances for use in manufacturing, in particular composite or additive manufacturing, such as lacquers, resins, epoxy, polymers, metals, cutting or drilling fluids. Other applications could involve solvents or specialty cleaning fluids, fuels in liquid or gaseous phases, lubricants or petrochemical products. The invention could be especially useful in liquid manufacturing processes, and for production of liquid pharmaceuticals as well as for containing hazardous waste products, pesticides or explosives whose transfer from one container to another must be tightly controlled and limited to a single transfer operation.

Further modifications will be apparent to those skilled in the art from a consideration of the disclosure provided herein. Consequently, it is not intended that this invention be limited to the specific embodiments provided herein, but that it covers all modifications and alternatives falling with the scope of the appended claims.

The invention claimed is:

1. A storage unit for storing a material, the storage unit comprising:

at least one wall, the at least one wall defining a chamber;

an opening;

a storage unit valve arranged at the opening to selectively seal the chamber, the storage unit valve being able to be selectively opened and closed to allow fluid to flow through the storage unit valve; and a storage unit keying mechanism configured to allow the storage unit to only connect to a complementary docking station keying mechanism disposed on a docking station for receiving the storage unit, the storage unit keying mechanism being movable relative to the storage unit valve to open or close the storage unit valve and being configured to move in response to movement of said docking station keying mechanism during engagement of the storage unit keying mechanism to said docking station keying mechanism;

wherein the storage unit valve is configured to only be able to be selectively opened and closed when the storage unit keying mechanism is engaged with said complementary docking station keying mechanism, wherein the storage unit keying mechanism comprises a casing having one or more protrusions configured to engage with one or more complementary slots formed in said docking station keying mechanism and thereby force away from the one or more complementary slots resilient tabs which are formed on an outer housing of the docking station disposed about at least a part of said docking station keying mechanism and which prevent movement of said docking station keying mechanism unless the storage unit keying mechanism is in engagement with said docking station keying mechanism.

2. The storage unit of claim 1, wherein the storage unit keying mechanism comprises:

an inner ring disposed within the casing and around the storage unit valve, the inner ring being configured to rotate around the storage unit valve, wherein rotation of the inner ring relative to the storage unit valve is configured to open or close the storage unit valve.

3. The storage unit of claim 2, wherein the storage unit valve comprises one or more pins, said pins being slidably disposed within an angled slot formed in the inner ring such that rotational movement of the inner ring causes an axial movement of the pins, and wherein the axial movement of the pins is configured to open or close the storage unit valve.

4. The storage unit of claim 1, wherein the storage unit further comprises an opening ratchet mechanism configured to only allow the storage unit valve to be opened from a fully closed state until the storage unit valve is in a fully open state.

5. The storage unit of claim 1, wherein the storage unit further comprises a closing ratchet mechanism configured to only allow the storage unit valve to be closed from a fully open state until the storage unit valve is in a fully closed state.

6. The storage unit of claim 4, wherein the opening ratchet mechanism and/or the closing ratchet mechanism is single-use, such that the storage unit valve can only be adjusted from a fully closed state to a fully open state once and/or from a fully open state to a fully closed state once.

7. The storage unit of claim 1, wherein the storage unit comprises a single-use valve configured to only be able to be adjusted, from a fully closed state to a fully open state once and from a fully open state to a fully closed state once.

8. The storage unit of claim 1, wherein the storage unit further comprises an indicator configured to indicate whether the storage unit valve has been in an open state.

9. The storage unit of claim 1, wherein the at least one wall is formed of metal and/or hard plastic.

10. The storage unit of claim 1, wherein the storage unit is an ink cartridge and the material is a fluid.

11. The storage unit of claim 3, wherein the angled slot comprises a parallel slot extending parallel to a central axis of the inner ring, a circumferential slot extending circumferentially to the central axis of the inner ring, and a slot connecting the parallel and circumferential slots.

12. A docking station for receiving a storage unit, the docking station comprising:

a docking station keying mechanism configured to engage with a complementary storage unit keying mechanism; and a docking station valve is configured to selectively open or close to selectively seal a flow path through the docking station;

wherein the docking station valve is configured to selectively open or close only when the docking station keying mechanism is engaged with said complementary storage unit keying mechanism, wherein the docking station further comprises resilient tabs which are formed on an outer housing of the docking station disposed about at least a part of the docking station keying mechanism and which prevent movement of the docking station keying mechanism unless the complementary storage unit keying mechanism is in engagement with the docking station keying mechanism, and wherein the docking station keying mechanism comprises one or more slots arranged to receive one or more complementary protrusions arranged on a casing of said storage unit keying mechanism, such that the one or more complementary protrusions force the resilient tabs away from the one or more slots, wherein movement of the docking station keying mechanism is configured to selectively open and close the docking station valve.

13. The docking station of claim 12, wherein the docking station further comprises a docking station indicator configured to show whether the docking station valve is in an open state or a closed state.

14. The docking station of claim 12, wherein the engagement between the docking station keying mechanism and said storage unit keying mechanism is configured to prevent disengagement of the docking station keying mechanism with the storage unit keying mechanism unless the docking station valve is in a fully closed state.

15. A system comprising a storage unit, the storage unit comprising at least one wall, the at least one wall defining a chamber;

an opening;

a storage unit valve arranged at the opening to selectively seal the chamber, the storage unit valve being able to be selectively opened and closed to allow fluid to flow through the storage unit valve; and a storage unit keying mechanism configured to allow the storage unit to only connect to a complementary docking station keying mechanism disposed on a docking station for receiving the storage unit, the storage unit keying mechanism being movable relative to the storage unit valve to open or close the storage unit valve and being configured to move in response to movement of said docking station keying mechanism during engagement of the storage unit keying mechanism to said docking station keying mechanism;

wherein the storage unit valve is configured to only be able to be selectively opened and closed when the storage unit keying mechanism is engaged with said complementary docking station keying mechanism, wherein the storage unit keying mechanism comprises a casing having one or more protrusions configured to engage with one or more complementary slots formed in said docking station keying mechanism and thereby force away from the one or more complementary slots resilient tabs which are formed on an outer housing of the docking station disposed about at least a part of said docking station keying mechanism and which prevent movement of said docking station keying mechanism unless the storage unit keying mechanism is in engagement with said docking station keying mechanism; and a docking station for receiving the storage unit, the docking station comprising:

a docking station keying mechanism configured to engage with a complementary storage unit keying mechanism; and a docking station valve is configured to selectively open or close to selectively seal a flow path through the docking station;

wherein the docking station valve is configured to selectively open or close only when the docking station keying mechanism is engaged with said complementary storage unit keying mechanism, wherein the docking station further comprises resilient tabs which are formed on an outer housing of the docking station disposed about at least a part of the docking station keying mechanism and which prevent movement of the docking station keying mechanism unless the complementary storage unit keying mechanism is in engagement with the docking station keying mechanism, and wherein the docking station keying mechanism comprises one or more slots arranged to receive one or more complementary protrusions arranged on a casing of said storage unit keying mechanism, such that the one or more complementary protrusions force the resilient tabs away from the one or more slots, wherein movement of the docking station keying mechanism is configured to selectively open and close the docking station valve.

16. The docking station of claim 12, wherein the docking station is part of a printer.

17. A method of connecting a storage unit to a docking station, the method comprising the steps of:

engaging the storage unit with the docking station by coupling a storage unit keying mechanism on the storage unit to a docking station keying mechanism on the docking station, moving the docking station keying mechanism to simultaneously open a storage unit valve and a docking station valve, thereby allowing fluid transfer from the storage unit into the docking station;

moving the docking station keying mechanism to simultaneously close the storage unit valve and the docking station valve, thereby preventing fluid transfer from the storage unit into the docking station; and disengaging the storage unit from the docking station by decoupling the storage unit keying mechanism from the docking station keying mechanism, wherein the storage unit comprises:

at least one wall, the at least one wall defining a chamber;

an opening;

a storage unit valve arranged at the opening to selectively seal the chamber, the storage unit valve being able to be selectively opened and closed to allow fluid to flow through the storage unit valve; and a storage unit keying mechanism configured to allow the storage unit to only connect to a complementary docking station keying mechanism disposed on a docking station for receiving the storage unit, the storage unit keying mechanism being movable relative to the storage unit valve to open or close the storage unit valve and being configured to move in response to movement of said docking station keying mechanism during engagement of the storage unit keying mechanism to said docking station keying mechanism;

wherein the storage unit valve is configured to only be able to be selectively opened and closed when the storage unit keying mechanism is engaged with said complementary docking station keying mechanism, wherein the storage unit keying mechanism comprises a casing having one or more protrusions configured to engage with one or more complementary slots formed in said docking station keying mechanism and thereby force away from the one or more complementary slots resilient tabs which are formed on an outer housing of the docking station disposed about at least a part of said docking station keying mechanism and which prevent movement of said docking station keying mechanism unless the storage unit keying mechanism is in engagement with said docking station keying mechanism; and the docking station comprises a docking station keying mechanism configured to engage with a complementary storage unit keying mechanism; and a docking station valve is configured to selectively open or close to selectively seal a flow path through the docking station;

wherein the docking station valve is configured to selectively open or close only when the docking station keying mechanism is engaged with said complementary storage unit keying mechanism, wherein the docking station further comprises resilient tabs which are formed on an outer housing of the docking station disposed about at least a part of the docking station keying mechanism and which prevent movement of the docking station keying mechanism unless the complementary storage unit keying mechanism is in engagement with the docking station keying mechanism, and wherein the docking station keying mechanism comprises one or more slots arranged to receive one or more complementary protrusions arranged on a casing of said storage unit keying mechanism, such that the one or more complementary protrusions force the resilient tabs away from the one or more slots, wherein movement of the docking station keying mechanism is configured to selectively open and close the docking station valve.

* * * * *